US011460793B2

(12) United States Patent
Matsuura et al.

(10) Patent No.: US 11,460,793 B2
(45) Date of Patent: Oct. 4, 2022

(54) IMAGE FORMING APPARATUS

(71) Applicant: CANON KABUSHIKI KAISHA, Tokyo (JP)

(72) Inventors: Daigo Matsuura, Tokyo (JP); Kengo Sato, Koshigaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/811,644

(22) Filed: Mar. 6, 2020

(65) Prior Publication Data

US 2020/0285181 A1 Sep. 10, 2020

(30) Foreign Application Priority Data

Mar. 8, 2019 (JP) ..... JP2019-042676

(51) Int. Cl.
*G03G 15/20* (2006.01)
*G03G 15/23* (2006.01)

(52) U.S. Cl.
CPC ..... *G03G 15/2053* (2013.01); *G03G 15/2028* (2013.01); *G03G 15/235* (2013.01)

(58) Field of Classification Search
CPC ..... G03G 15/2028; G03G 15/6573; G03G 2215/0043; G03G 2215/00417; G03G 15/235
See application file for complete search history.

(56) References Cited

U.S. PATENT DOCUMENTS 8,867,980 B2 * 10/2014 Inoue ..... G03G 15/657 399/381
9,274,473 B2 * 3/2016 Mogi ..... G03G 15/2064
2012/0195606 A1 * 8/2012 Miyajima ..... G03G 15/2028 399/33

FOREIGN PATENT DOCUMENTS

JP 2000194216 A 7/2000
JP 2011180412 A * 9/2011

* cited by examiner

*Primary Examiner* — Erika J. Villaluna
(74) *Attorney, Agent, or Firm* — Venable LLP

(57) ABSTRACT

An image forming apparatus includes an image forming unit, a fixing unit including a first rotary member and a second rotary member, a reciprocation mechanism configured to reciprocally move the fixing unit in a width direction, a duplex conveyance unit configured to reverse a recording material of which a toner image is fixed on a first surface and reconvey the recording material to the image forming unit in a double-sided image formation in which toner images are formed and fixed on the first surface and second surfaces of the recording material, and a control unit configured to control the reciprocation mechanism not to move the fixing unit in the width direction while the fixing unit is nipping and conveying the recording material at a fixing nip portion for fixing the toner image on the first surface of the recording material in the double-sided image formation.

11 Claims, 11 Drawing Sheets

IMAGE FORMING APPARATUS

BACKGROUND OF THE INVENTION

Field of the Invention

The present invention relates to an image forming apparatus using an electrophotographic technology, such as a printer, a copy machine, a facsimile, and a multifunction device.

Description of the Related Art

An image forming apparatus includes a fixing unit which fixes a toner image on a recording material by providing a heat and pressure on the recoding material formed with an unfixed toner image. The fixing unit includes a fixing roller and a pressurizing roller. The pressurizing roller abuts on the fixing roller and pressurizes the fixing roller. The toner image is fixed on the recording material by the recording material conveyed through a nip portion formed between the fixing roller and the pressurizing roller in a sandwiched manner and provided with the heat and pressure.

To prevent an adhesion of toner from the recording material, a surface layer of the fixing roller (or the fixing belt) is made of, for example, soft resin, such as PFA and PTFE, having a relatively good release characteristic. Therefore, a surface of the fixing roller is liable to get abraded in a rotational direction (a circumferential direction) at passing the recording material through the fixing nip portion due to a burr on a cutting edge of the recording material created at a cutting process of the recording material. This flaw (hereinafter referred to as a "paper edge flaw") is apt to grow deeper and larger by repeatedly passing the recording material through a same place on the fixing roller. When a deep and large flaw is formed on the surface of the fixing roller, a stripe-shaped image defect is possibly generated because the flaw overlaps the printing area of the recording material at passing the recording material of a maximum size in a width direction intersecting with a conveying direction of the recording material through the fixing nip portion. Then, an image forming apparatus in which a fixing unit is reciprocally moved in the width direction (hereinafter referred to as a "reciprocal motion") and the paper edge flaw is scattered in the width direction to prevent a local generation of the deep and large flaw is hitherto proposed (Japanese Patent Laid-Open No. 2000-194216). To reduce a time required for an image formation, the fixing unit (in particular, the fixing nip portion) is hitherto moved in the width direction with sandwiching the recording material between a pair of conveyance rollers which are provided at a downstream of the fixing unit in the conveyance direction of the recording material and convey the recording material discharged from the fixing unit in a sandwiched manner.

Incidentally, in the image forming apparatus there is a double-sided image forming apparatus of a so-called through-pass method in which a formation and a fixing of the toner image on a second surface is automatically carried out successively after the fixing of the toner image on a first surface of the recording material. In a case of the image forming apparatus of this method, it happens that the recording material is conveyed on a skew and the toner image formed and fixed on the recording material is tilted at the formation and the fixing of the toner image on the second surface due to the width direction reciprocal motion carried out during the fixing of the toner image on the first surface. That is, there is a possibility of discrepancies in image positions on the first surface and the second surface (so-called "front/rear registration"). Therefore, as a configuration of the fixing unit capable of carrying out the reciprocal motion, it has been hitherto requested to compatibly suppress both the local generation of the paper edge flaw and the discrepancies in the image positions on the first and second surfaces, but such a configuration still has not been proposed.

SUMMARY OF THE INVENTION

According to a first aspect of the present invention, an image forming apparatus includes an image forming unit configured to form a toner image on a recording material, a fixing unit including a first rotary member and a second rotary member, the second rotary member being configured to abut on the first rotary member and form a fixing nip portion between the first rotary member for fixing the toner image formed by the image forming unit on the recording material, wherein, at the fixing nip portion, the recording material is nipped and conveyed by the first and second rotary members, a reciprocation mechanism configured to reciprocally move the fixing unit in a width direction intersecting with a conveyance direction of the recording material, a duplex conveyance unit configured to reverse a recording material of which a toner image is fixed on a first surface and reconvey the recording material to the image forming unit in a double-sided image formation in which toner images are formed and fixed on the first surface and second surfaces of the recording material, and a control unit configured to control the reciprocation mechanism not to move the fixing unit in the width direction while the fixing unit is nipping and conveying the recording material at the fixing nip portion for fixing the toner image on the first surface of the recording material in the double-sided image formation.

According to a second aspect of the present invention, an image forming apparatus includes an image forming unit configured to form a toner image on a recording material, a fixing unit including a first rotary member and a second rotary member, the second rotary member configured to abut on the first rotary member and form a fixing nip portion between the first rotary member for fixing the toner image formed by the image forming unit on the recording material, wherein, at the fixing nip portion, the recording material is nipped and conveyed by the first and second rotary members, a reciprocation mechanism configured to reciprocally move the fixing unit in a width direction intersecting with a conveyance direction of the recording material, a duplex conveyance unit configured to reverse a recording material of which a toner image is fixed on a first surface and reconvey the recording material to the image forming unit in a double-sided image formation in which toner images are formed and fixed on the first and second surfaces of the recording material, and a control unit configured to control the reciprocation mechanism in the double-sided image formation such that the fixing unit moves by a first moving amount in a case where the recording material with the toner image formed on a first surface is at the fixing nip portion, and moves by a second moving amount, which is larger than the first moving amount, in a case where the recording material with the toner image formed on a second surface is at the fixing nip portion.

Further features of the present invention will become apparent from the following description of exemplary embodiments with reference to the attached drawings.

DESCRIPTION OF THE EMBODIMENTS

Image Forming Apparatus

Figure 1:
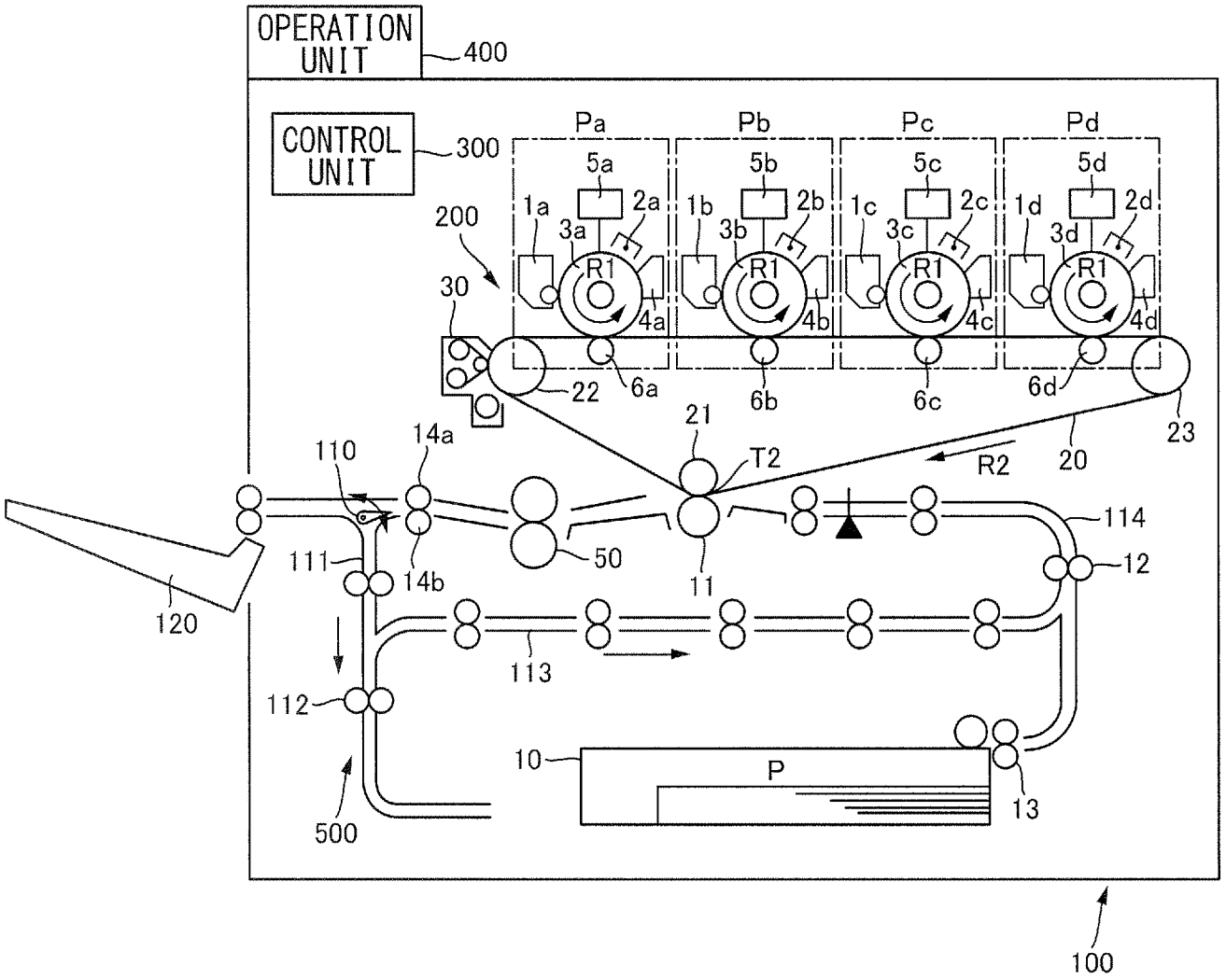
FIG. 1 is a configuration diagram of an image forming apparatus according to a first embodiment.

A fixing unit according to a first embodiment of the present invention will be described below. First, with reference to FIG. 1, an image forming apparatus suiting for use of the fixing unit according to this embodiment will be described. An image forming apparatus 100 illustrated in FIG. 1 is a intermediate transfer tandem type full color printer in which image forming units Pa, Pb, Pc, and Pd for yellow, magenta, cyan, and black, respectively, are arrayed along an intermediate transfer belt 20. A standard paper, a thick paper, a rough paper, an uneven paper, and a coated paper are examples of a recording material P usable for the image forming apparatus 100. In this embodiment, the image forming unit 200 forming a toner image on the recording material P includes the image forming units Pa to Pd, primary transfer rollers 6*a* to 6*d*, the intermediate transfer belt 20, a secondary transfer inside roller 21, a secondary transfer outside roller 11, and stretch rollers 22 and 23.

A conveyance process of the image forming apparatus 100 will be described. The recording material P is stored in a paper feeding cassette 10 in a stacked form, and is sent out by a paper feeding roller 13 in synchronizing with a timing of an image formation. The recording material P sent out by the paper feeding roller 13 is conveyed to a registration roller 12 located on a conveyance path 114. And after having corrected a skew and a time lag of the recording material P by the registration roller 12, the recording material P is conveyed to a secondary transfer portion T2. The secondary transfer portion T2 is a transfer nip portion formed by the secondary transfer inside roller 21 and the secondary transfer outside roller 11 while interposing the intermediate transfer belt 20 therebetween, and transfers a toner image on the recording material P by charging a secondary transfer voltage on the secondary transfer outside roller 11. In the present embodiment, the intermediate transfer belt 20 serves as an image bearing member configured to bear a toner image and the secondary transfer outside roller 11 serves as a transfer member configured to form the transfer nip portion to transfer the toner image on the image bearing member to the recording material.

An image forming process which sends an image to the secondary transfer portion T2 in approximately synchronized in timing with the conveyance process of the recording material P as described above will be described. At first, the image forming units are described. The image forming units Pa, Pb, Pc, and Pd have an approximately same structure, but are different in colors of toners used in each of developing units 1*a*, 1*b*, 1*c*, and 1*d* in which yellow, magenta, cyan, and black are used, respectively. Accordingly, as a representative, the image forming unit Pd of black is described below and description of other image forming units Pa, Pb, and Pc is omitted herein.

The image forming unit Pd is mainly configured with the developing unit 1*d*, a charge unit 2*d*, a photosensitive drum 3*d*, a photosensitive drum cleaner 4*d*, and an exposing unit 5*d*. A surface of the photosensitive drum 3*d* rotating in an arrow R1 direction in FIG. 1 is uniformly charged by the charging unit 2*d* in advance, and thereafter an electrostatic latent image is formed on the surface of the photosensitive drum 3*d* by the exposing unit 5*d* driven with an image information signal. Then, the electrostatic latent image formed on the surface of the photosensitive drum 3*d* is developed to a toner image by use of a developing agent by the development unit 1*d*, and is transferred to an intermediate transfer belt 20 by charging a primary transfer voltage on a primary transfer roller 6*d* opposing the image forming unit Pd across an intermediate transfer belt 20. A small quantity of toners remaining on the photosensitive drum 3*d* is collected by the photosensitive drum cleaner 4*d*, and the photosensitive drum 3*d* is brought back again to a next image forming process.

The intermediate transfer belt 20 is stretched by the secondary transfer inside roller 21, a tension roller 22, and a stretch roller 23, and is driven in an arrow R2 direction in FIG. 1. In a case of this embodiment, the secondary transfer inside roller 21 works also as a driving roller which drives the intermediate transfer belt 20. The image forming process of each color by the image forming units Pa to Pd is carried out in parallel and in timing of sequentially overlaying on the intermediate transfer belt 20 the toner image of respective color over the primary transferred toner image of an upstream color. Consequently, the toner image of full color is finally formed on the intermediate transfer belt 20, and transferred to the secondary transfer portion T2. To be noted, after passing the secondary transfer portion T2 remaining secondary transfer toner is collected by a transfer cleaner unit 30.

Accordingly, by the conveyance and image forming process as described above, a conveyance of the recording material P coincides in timing with a full color toner image at the secondary transfer portion T2, and a secondary transfer is carried out. Subsequently, the recording material P is conveyed to a fixing unit 50, and the toner image is fixed on the recording material P by being provided with a predetermined pressure and heat. The recording material P with the toner image fixed as described above is, in a case of a single-sided image formation, discharged without further processing onto a sheet discharge tray 120 in a sandwiched manner between sheet discharge rollers 14*a* and 14*b*, which are a pair of conveyance members. On the other hand, in a case of a double-sided image formation, a conveyance path is switched to a duplex conveyance path 111 from a path toward the sheet discharge tray 120 by a switching member 110 (so-called "flapper"). Then, a front and trailing edges are reversed by a reverse roller 112, and the recording material P is sent to the conveyance path 114 again via a duplex path 113. Since subsequent conveyance and image forming process on a rear surface (a second surface) are identical with those described above, description thereof is omitted herein. In this embodiment, a duplex conveyance unit 500 which conveys the recording material P to the image forming unit 200 again with reversing the front and trailing edges of the recoding material P after fixing the toner image on the first surface is configured with the switching member 110, the duplex conveyance path 111, the reverse roller 112, and the duplex path 113.

Fixing Unit

Figure 2:
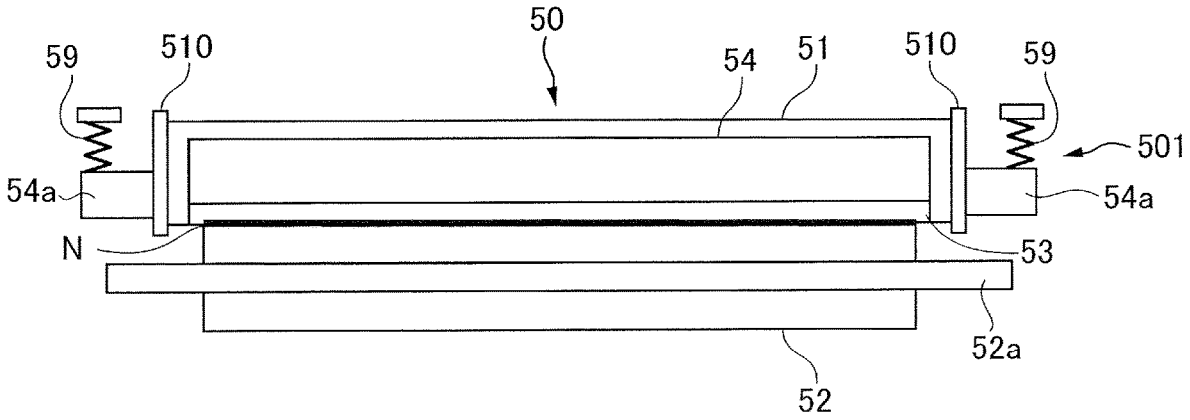
FIG. 2 is a schematic view of a fixing unit.

Next, a fixing unit 50 of this embodiment will be described with reference to FIGS. 2 and 4. As illustrated in FIG. 2, the fixing unit 50 of this embodiment includes a fixing belt assembly 501 and a pressurizing roller 52. The pressurizing roller 52 as a second rotary member is rotatably installed in an apparatus body with both edges of a rotation shaft 52*a* being born on bearings, not shown, each provided on both side plates of the apparatus body. The pressurizing roller 52 is positioned in parallel to the fixing belt assembly 501, and abuts on a fixing belt 51 of the fixing belt assembly 501 so that the pressurizing roller 52 is installed to be capable of pressurizing the fixing belt 51.

The pressurizing roller 52, not shown, is for example provided with an elastic layer of a silicon rubber in a uniform thickness around a crown-shaped metal core bar having a diameter of 20 mm at a center in a width direction (rotational axis direction) intersecting with the conveyance path of the recording material P and a diameter of 19 mm at edges. On a surface of the elastic layer, a fluoroplastics (such as perfluoroalkoxyfluoroplastics (PFA) and polytetrafluoroethylene (PTFE)) is laminated in a thickness of 30 μm. When the pressurizing roller 52 of a crown-shaped is used, a fixing nip portion N is formed between the fixing belt 51 and the pressurizing roller 52, and a pressure in the fixing nip portion N is preferably maintained uniformly along the width direction even in a case where a pressurizing pad 53 described later bends. A hardness of the pressurizing roller 52 at the center of shaft in the width direction is for example ASK-C 70 degree. To be noted, the pressurizing roller 52 may be a belt-shaped pressurizing belt.

Fixing Belt Assembly

The fixing belt assembly 501 is configured to be capable of reciprocating toward the pressurizing roller 52. The fixing belt assembly 501 includes the fixing belt 51 as a first rotary member, formed in a cylindrical shape (endless shape) and having an elastic characteristic, and a flange 510 holding the fixing belt 51 at both ends in the width direction intersecting with the conveyance path of the recording material P. To be noted, the fixing belt 51 described herein includes thin film-shaped.

Fixing Belt

Figure 3:
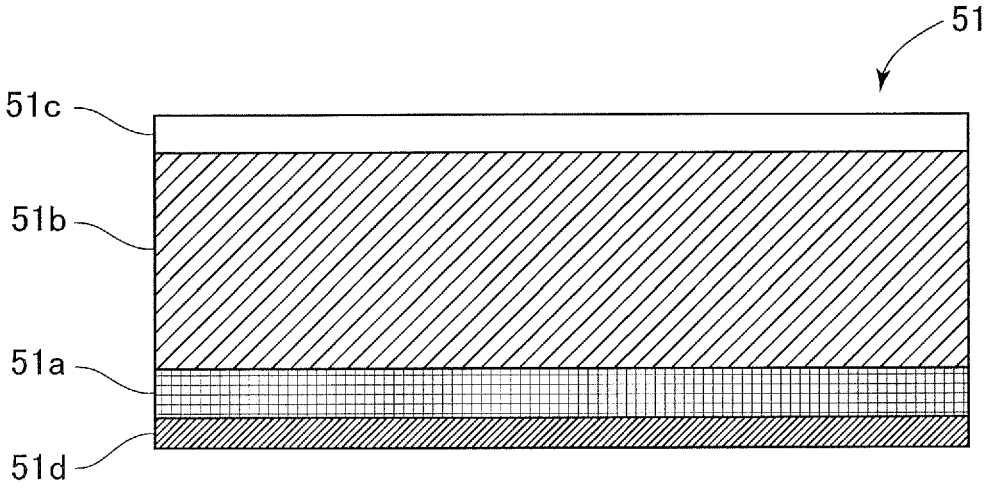
FIG. 3 is a cross-sectional view illustrating a configuration of layers of a fixing belt.

A layer configuration of the fixing belt 51 will be described with reference to FIG. 3. As illustrated in FIG. 3, in sequence from inside to outside, the fixing belt 51 has layers of a sliding layer 51*d*, a base layer 51*a*, an elastic layer 51*b*, and a mold release layer 51*c*. The fixing belt 51 includes the base layer 51*a* (an electrically conductive layer) formed in an inside diameter approximately from 20 to 40 mm. The base layer 51*a* is formed in a thickness of 40 μm, for example. The thickness of the base layer 51*a* is adjusted, for example, between approximately 5 and 200 μm in accordance with a frequency of a high frequency current applied to an exciting coil 56 described later (refer to FIG. 4) and magnetic permeability and electric conductivity of the base layer 51*a*. An iron alloy, a nickel alloy, copper, silver, and the like may be appropriately chosen for the base layer 51*a* described above.

On a circumference of the base layer 51*a*, the elastic layer 51*b* of a heat-resistant rubber is formed. It is preferred to form the elastic layer 51*b* in a thickness from 100 to 1000 μm. In this embodiment, in order to decrease a thermal capacity of the fixing belt 51 to shorten a warming up time required at a start and to obtain a preferred fixed image at a fixing of a color image, the thickness of the elastic layer 51*b* is set at 300 μm. The elastic layer 51*b* is, for example, made of a silicon rubber having a JIS-A hardness of 20 degree and a thermal conductivity of 0.8 W/mK. On the circumference of the elastic layer 51*b*, the mold release layer 51*c* is formed to enhance a release characteristic against a toner. The mold release layer 51*c* is a layer of a fluoroplastics such as PFA and PTFE, and is formed in a thickness of 30 μm, for example.

On the other hand, on an inner circumference of the base layer 51*a*, to reduce a sliding friction with a pressurizing pad 53 described later and a temperature sensor TH (refer to FIG. 4) the sliding layer 51*d* is composed of such as fluoroplastics and polyimide in a thickness from 10 to 50 μm. In this embodiment, the sliding layer 51*d* is composed of polyimide and in a thickness of 20 μm. To be noted, the fixing belt 51 may be a roller-shaped fixing roller having an elastic layer on a surface thereof.

Referring back to FIG. 2, in this embodiment, the flange 510 is outwardly engaged on both ends of the fixing belt 51. The flange 510 holds the fixing belt 51 and restricts a movement of the fixing belt 51 in the width direction by catching the edges of the fixing belt 51 in the width direction when the fixing belt 51 moves toward the edges in the width direction. In other words, when the fixing belt 51 moves in the width direction by drivingly rotated by the pressurizing roller 52, further movements of the fixing belt 51 in a width direction is restricted by one of the edges in the width direction butting with the flange 510. That is, it happens that the pressurizing roller 52 and the fixing belt 51 are installed slightly not in parallel each other by errors at assembly. In such a case, the fixing belt 51 may be rotated by the pressurizing roller 52 in rotation and moved in the width direction. Therefore, to restrict the movement of the fixing belt 51 in the width direction caused by the pressurizing roller 52, the pair of the flanges 510 is outwardly engaged at the both ends of the fixing belt 51.

In this embodiment, an arm portion 54*a* of a stay 54 is urged toward the pressurizing roller 52 by a stay pressing spring 59 with a predetermined urging force. By this arrangement, the fixing belt 51 and the pressurizing roller 52 contact each other with an intended force of pressure contact. By the pressure contact of the fixing belt 51 and the pressurizing roller 52, the fixing nip portion N is formed to pass the recording material P between the fixing belt 51 and the pressurizing roller 52 under a pressurized condition and thermally fix the toner image on the recording material P. In this embodiment, when the pressure of the fixing nip portion N is 600 N, rotational direction lengths of the fixing nip portion N in a rotational axis direction are set at approximately 9 mm at both ends and approximately 8.5 mm at a center. By differentiating the rotational direction lengths of the fixing nip portion N at the both ends and the center of the rotational axis as described above, it is possible to set a conveyance speed of the both ends faster than the conveyance speed of the center, and possible to advantageously suppress a wrinkle formation on the recording material P. In the present embodiment, a formation of the fixing nip portion N is secured by urging the fixing belt 51 from inside toward the pressurizing roller 52 with the pressurizing pad 53 supported by the stay 54.

Figure 4:
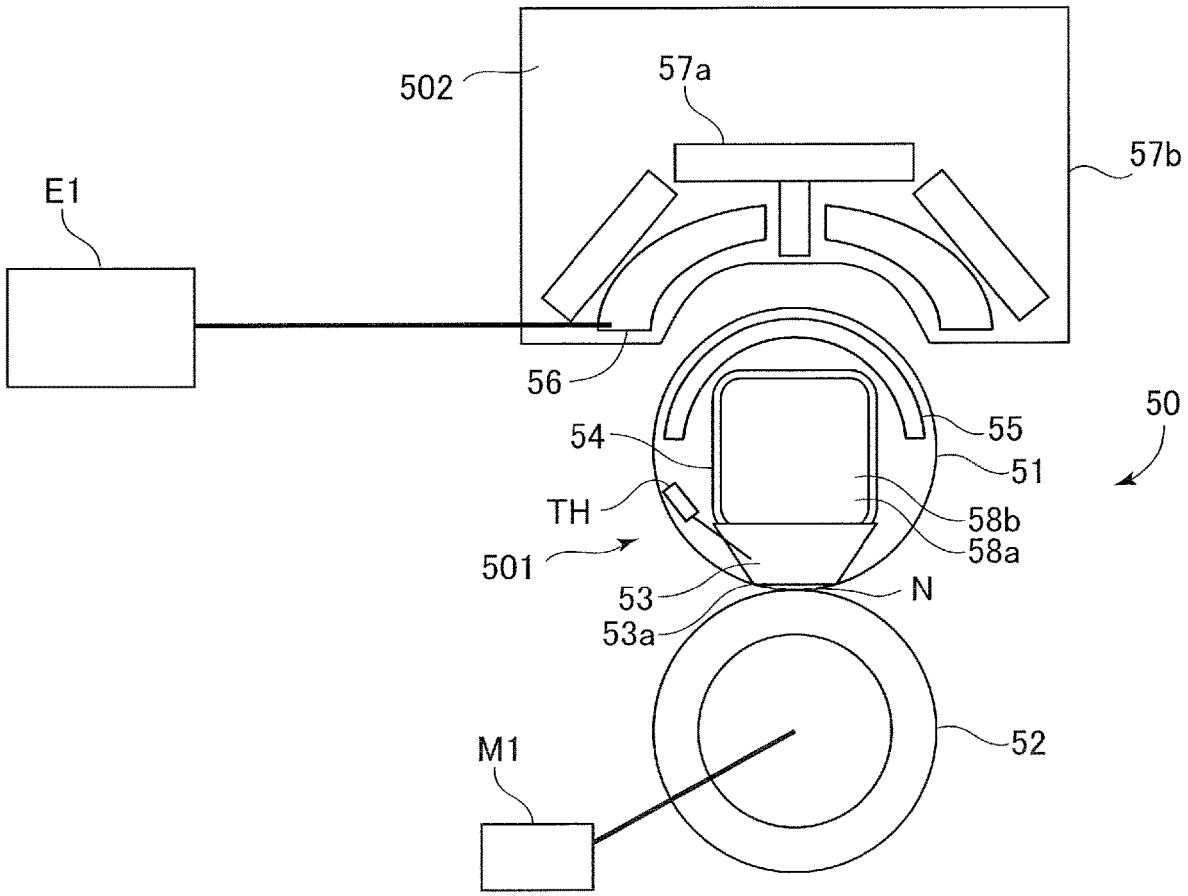
FIG. 4 is a cross-sectional view of the fixing unit.

As illustrated in FIG. 4, the pressurizing roller 52 is rotated by a turning force of a motor M1 being transmitted via a power transmission mechanism, not shown. And, as the fixing nip portion N is formed between the fixing belt 51 and the pressurizing roller 52, a friction force generated at the fixing nip portion N transmits the turning force of the pressurizing roller 52 to the fixing belt 51. As described above, the fixing belt 51 is drivingly rotated by the pressurizing roller 52 (so-called "pressurizing roller driven method"). In this embodiment, as the fixing belt is rotated at a rotational speed of 300 mm/sec, the fixing unit 50 is capable of fixing 80 sheets of A4 size sheet in a full color in a minute and 58 sheets in a minute in case of A4R size sheet.

The fixing belt assembly 501 includes the pressurizing pad 53, the stay 54, and a magnetic shielding core 55 inside the endless-shaped fixing belt 51. The pressurizing pad 53 is to form the fixing nip portion N between the fixing belt 51 and the pressurizing roller 52 by providing pressure, and is held by the stay 54 made of metal. The pressurizing pad 53 is, for example, a molded product of a heat-resistant resin extending in the width direction, and is pressed toward the fixing belt 51. The stay 54 is a plate-shaped member extending in the width direction of the fixing belt 51. As the stay 54 needs a stiffness to add pressure, in the present embodiment, the stay 54 is made of iron, for example. The stay 54 is positioned in adjacent to the exciting coil 56, particularly at the both ends of the fixing belt 51, in the width direction. To prevent a heat generation in the stay 54 by a magnetic field generated in the exciting coil 56, the magnetic shield core 55 is provided between the exciting coil 56 and the stay 54 to shield the magnetic field along the width direction.

Induction Heating Unit

Also, the fixing unit 50 includes a temperature sensor TH to detect a temperature of the fixing belt 51 and an induction heating unit 502 to heat the fixing belt 51 by an induction heating. The induction heating unit 502 as a heating unit is installed at a position securing a predetermined space with a circumference surface of the fixing belt 51 and opposing the magnetic shield core 55. The induction heating unit 502 includes the exciting coil 56, an outer magnetic core 57*a*, and a mold member 57*b*. The exciting coil 56 is, for example, a litz wire coiling an electric wire and extending in the width direction, and is formed along the circumference surface of the fixing belt 51 in a curved shape (ship bottom shape).

A power source E1 for such as an exciting circuit is coupled to the exciting coil 56, and applies a high frequency current, for example from 20 to 50 kHz. The exciting coil 56 generates an alternating magnetic field (magnetic flux) by an application of the high frequency current. When the alternating magnetic field is generated by the exciting coil 56, the fixing belt 51 (in particular, the base layer 51*a* (refer to FIG. 3)) is heated by the induction heating. To heat the fixing belt 51 with the induction heating efficiently, the outer magnetic core 57*a* is composed of a high magnetic permeability member such as a ferrite capable of shielding the alternating magnetic field. Also, the outer magnetic core 57*a* is configured to cover the exciting coil 56, and suppresses a leakage of alternating magnetic field. The exciting coil 56 and the outer magnetic core 57*a* as described above are supported by the mold member 57*b* made of an electric insulation resin.

The temperature sensor TH is, for example, such as a thermistor, and detects the temperature of the fixing belt 51 by being installed approximately at a center of the fixing belt 51 in the width direction and in contact with an inner circumference of the fixing belt 51. At the fixing unit 50, the high frequency current applied to the exciting coil 56 by the power source E1 is controlled so as to maintain a temperature (in particular, a surface temperature) of the fixing belt 51 at a desired target temperature. In this embodiment, a temperature control by the exciting coil 56 is carried out by varying frequency of the high frequency current applied to the exciting coil 56 by the power source E1 based on detection results of the temperature sensor TH so as to keep the temperature of the fixing belt 51 at the target temperature of 180° C. To be noted, when the temperature of the fixing belt 51 has reached at the target temperature, an electricity to the exciting coil 56 is disconnected.

At the fixing unit 50 described above, under a condition that a temperature of the fixing belt 51 is kept at the desired target temperature, the recording material P with toner image unfixed is conveyed to the fixing nip portion N. The recording material P is conveyed in a manner where a side of an unfixed toner image is facing the fixing belt 51. The recording material P passes the fixing nip portion N by being conveyed in a sandwiched manner between the fixing belt 51 and the pressurizing roller 52 each rotating. And the toner image is fixed on the recording material P by heated by the fixing belt 51 under pressurized with the fixing belt 51 and the pressurizing roller 52. The surface of the fixing belt 51 deforms at an exit of the fixing nip portion N, and the recording material P passed the fixing nip N is automatically separated from the circumference of the fixing belt 51 and discharged to outside the fixing unit 50.

Reciprocation Mechanism

Figure 5A:
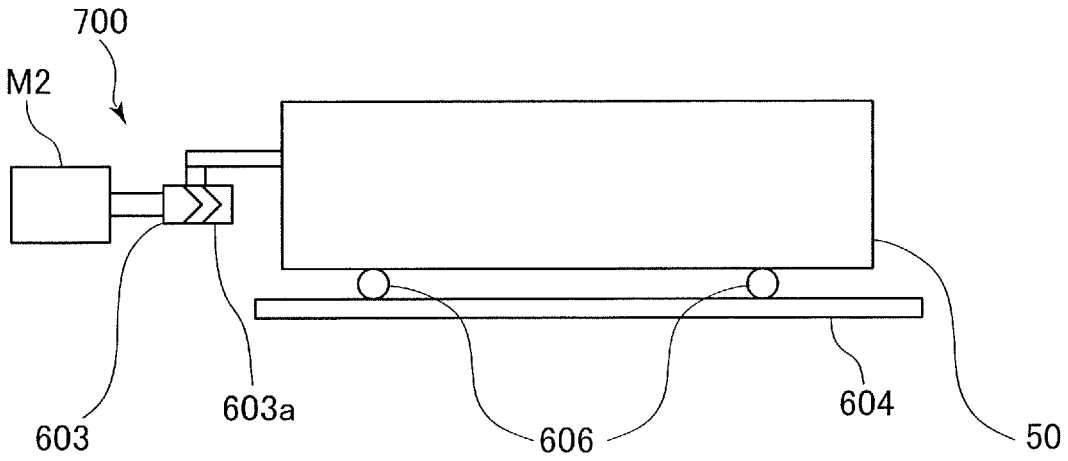
FIG. 5A is an explanatory schematic side view of a reciprocation mechanism.
Figure 5B:
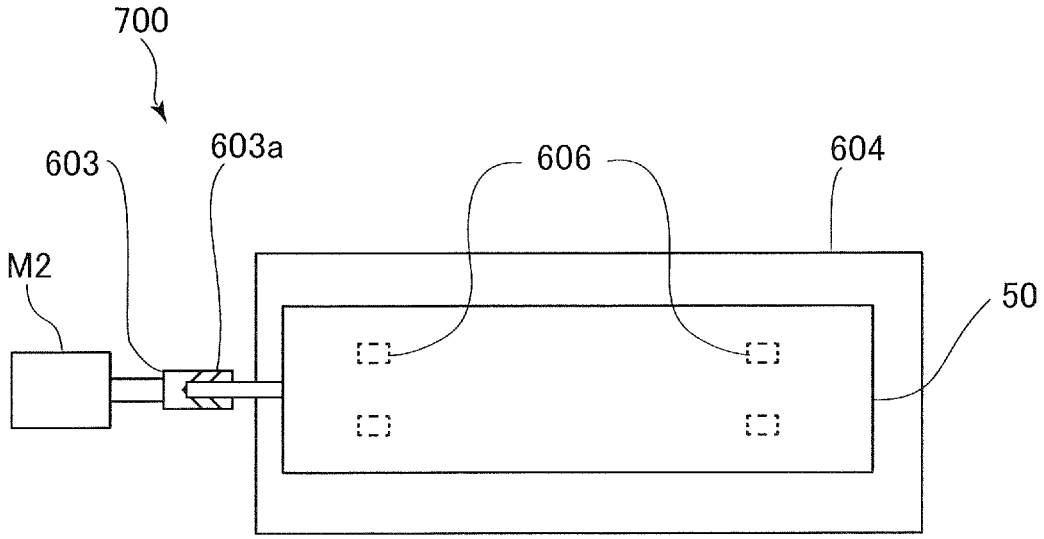
FIG. 5B is an explanatory schematic top view of the reciprocation mechanism.

Next, a reciprocation mechanism 700, which scatters in the width direction a flaw caused by a paper edge defect and suppresses a local generation of a deep and large flaw on a surface of the fixing belt 51, will be described with reference to FIGS. 5A and 5B. FIG. 5A illustrates a side view of the reciprocation mechanism 700, and FIG. 5B illustrates a top view of the reciprocation mechanism 700. In this embodiment, as illustrated in FIGS. 5A and 5B, since the fixing unit 50 is supported by rollers 606 and moves on a slider 604 by rotation of the rollers 606, the fixing unit 50 is configured to be reciprocally movable in the width direction.

The reciprocation mechanism 700 includes a reciprocation cam 603 and a reciprocation motor M2. A protrusion, not shown, engaging with a groove on the reciprocation cam 603 is provided on a side plate of the fixing unit 50. The reciprocation cam 603 is rotatably fixed to an apparatus body of the image forming apparatus 100 by the reciprocation motor M2. The reciprocation motor M2 is configured with a stepping motor, and controls rotation of the reciprocation cam 603. The reciprocation cam 603 is formed in a cylindrical shape having a groove 603*a* on a circumference surface thereof. The groove 603*a* is formed in a shape with which the reciprocation cam 603 is moved in an axial direction when the groove 603*a* proceeds in a circumferential direction. Specifically, the groove 603*a* is formed approximately in a V-shape as illustrated in FIGS. 5A and 5B.

The groove 603*a* engages with the protrusion provided on the fixing unit 50. When the reciprocation cam 603 rotates, the protrusion engaged with the groove 603*a* moves in the axial direction of the reciprocation cam 603 along the groove 603*a*. Since the reciprocation cam 603 fixed to the image forming apparatus 100 rotates as described above, the protrusion fixed to the fixing unit 50 moves in a rotational axis direction of the reciprocation cam 603. As a result, it is enabled to relatively move the recording material P conveyed by the image forming apparatus 100 and the fixing unit 50. Accordingly, the edge of the recording material P is not always positioned at one place on a surface of the fixing belt 51 (and of the pressurizing roller 52), and a delay in a progress of wear caused by a contact of the fixing belt 51 (and pressurizing roller 52) with the edge of the recording material P is enabled. To be noted, for example, by half rotation of the reciprocation cam 603, the fixing unit 50 is reciprocated in a range of 3 mm in the width direction (refer to FIG. 6). The groove 603*a* of the reciprocation cam 603 is configured to move the fixing unit 50 as described above.

Figure 6:
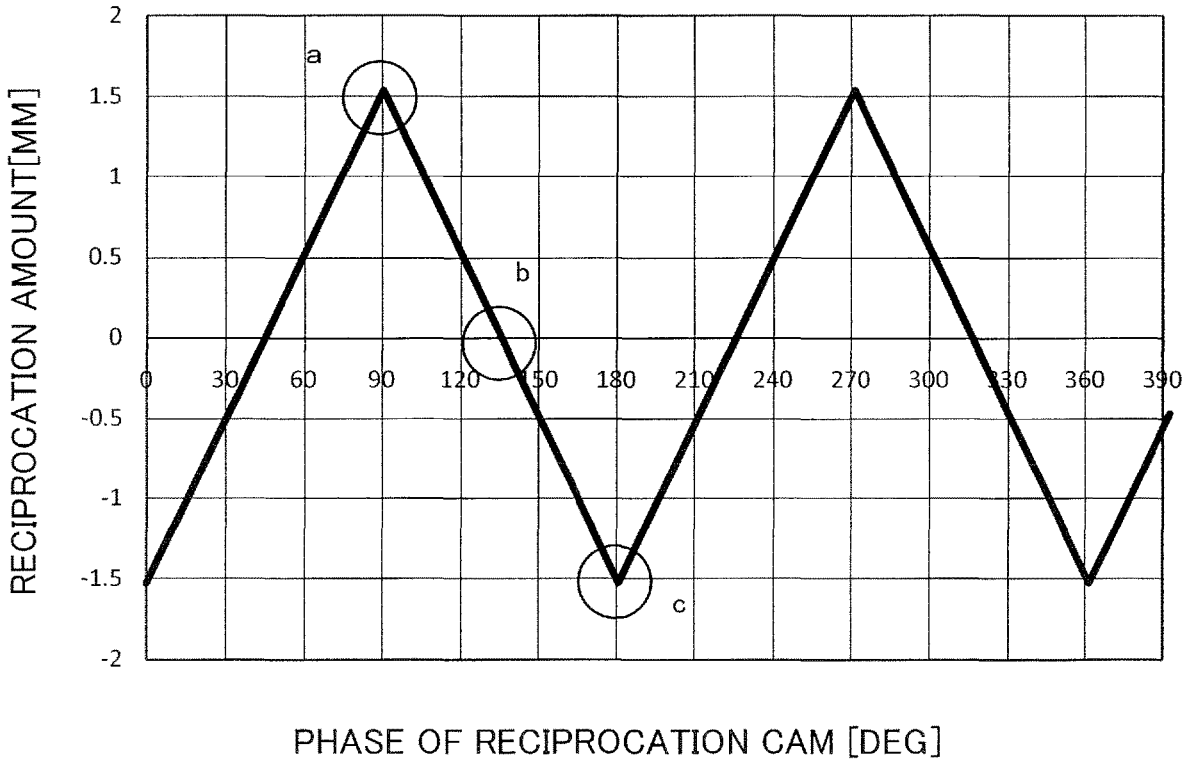
FIG. 6 is a graph illustrating a relation of a phase and a moving amount in a width direction of a reciprocation cam.

FIG. 6 illustrates a relation of a rotation angle (phase:deg) of the reciprocation cam 603 and a moving amount of the fixing unit 50 in the width direction (reciprocation amount: mm). As illustrated in FIG. 6, by rotating the reciprocation cam 603, it is possible to move a relative position of the fixing unit 50 to discharge rollers 14*a* and 14*b* in a constant cycle. To be noted, in a case of the recording material P of a largest size in a width for the image formation, an impact of the paper edge flaw does not become obvious since the recording material P of the larger size in the width is not fed. In this embodiment, at image forming on the recording material P of a maximum size in the width, the reciprocation movement is stopped at a position marked "b" in FIG. 6 to reduce a space to be secured in the body of the image forming apparatus 100 in the width direction, which includes the reciprocation amount of the fixing unit 50. The position marked "b" in FIG. 6 is the position where a center of the fixing nip portion N in the width direction coincides with a center of the discharge rollers 14*a* and 14*b* in the width direction (hereinafter referred to as a "reciprocation center"). And, in this embodiment, all of reciprocation movement of the fixing unit 50 in the width direction is referred to as "reciprocal motion", and a unit amount of movement (that is, an amount of movement at each time) of the fixing unit 50 in the reciprocation movement is referred to as a "width direction reciprocal motion".

Figure 7:
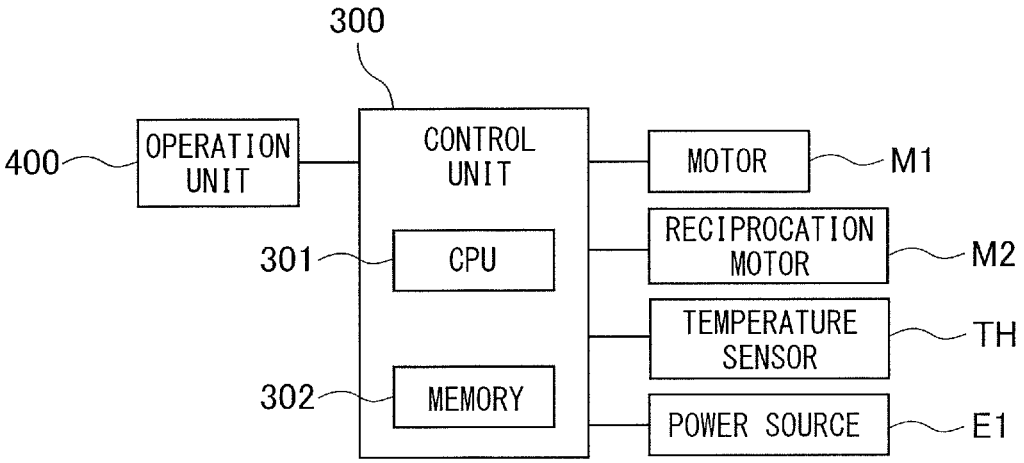
FIG. 7 is a control block diagram illustrating a control unit.

As illustrated in FIG. 1, the image forming apparatus 100 includes a control unit 300. The control unit 300 will be described using FIG. 7 with reference to FIG. 4. Although various kinds of equipment, such as a motor and a power source, are coupled to the control unit 300 other than those illustrated in FIG. 7, illustration and description thereof are omitted herein since they do not directly relate to a substance of the present invention.

As a control unit, the control unit 300 carries out various kinds of control of the image forming apparatus 100 such as the control of an image forming operation, and includes, for example, such as a CPU (central processing unit) 301 and a memory 302. The memory 302 is configured with such as a ROM (read only memory) and a RAM (random access memory). The memory 302 stores various programs for the control of the image forming apparatus 100 and various data such as a maximum size in the width of the recording material P acceptable to carry out an image formation and the position of the reciprocation center described above. The CPU 301 is able to execute the various programs stored in the memory 302 and operate the image forming apparatus 100 by executing the various programs. In the present embodiment, the CPU 301 is able to execute an image forming job processing (computer program) (not shown) and a reciprocation control processing (computer program) (refer to FIG. 8 described later). To be noted, the memory 302 is also able to temporally store calculation results obtained by executions of the various programs.

To the control unit 300, an operation unit 400 is coupled via an input/output interface. The operation unit 400 is, for example, such as an operation panel by which a user instructs to execute the various programs such as the image forming job and inputs various data such as a size of the recording material P (A3, B4 and the like).

The image forming job means a sequence of actions from a start of an image formation based on a print signal for forming an image on the recording material P to a completion of the image formation. That is, a sequence of operations from a start of a preparatory operation needed for the image formation (so-called a preceding rotation) to the preparatory operation needed for completion of the image formation (so-called a subsequent rotation). Specifically, the image forming job means operations carried out from the preceding rotation (preparatory operation before the image formation), which is carried out after receiving a print signal, to the subsequent rotation (preparatory operation after the image formation), and includes operations in a period of the image formation and a sheet interval.

Further, the motor M1, the reciprocation motor M2, the power source E1, and the temperature sensor TH are coupled to the control unit 300 via an input/output interface. When a start of the image forming job is instructed from the operation unit 400, the control unit 300 (in particular, the CPU 301) executes the image forming job processing stored in the memory 302. The control unit 300 controls the image forming apparatus 100 by executing the image forming job processing. Accordingly, the control unit 300 drivingly rotates the pressurizing roller 52 with the motor M1, and rotates the fixing belt 51. And, the control unit 300 controls the induction heating unit 502 with the power source E1 so that temperature on a surface of the fixing belt 51 is as high as the desired target temperature (for example, 180° C.). That is, when the control unit 300 receives an input of the image forming job, the control unit 300 turns on electricity to the exciting coil 56 from the power source E1, and controls an input current to the exciting coil 56 to obtain the target temperature on the surface of the fixing belt 51. At this time, the control unit 300 controls the input current to the exciting coil 56 based on the detection results of the temperature sensor TH. The control unit 300 controls the reciprocation motor M2 to drivingly rotate the reciprocation cam 603, and it is enabled to carry out the width direction reciprocal motion of the fixing unit 50 as described above at each discharge of a predetermined number of sheets of the recording material P from the fixing nip portion N.

Figure 10A:
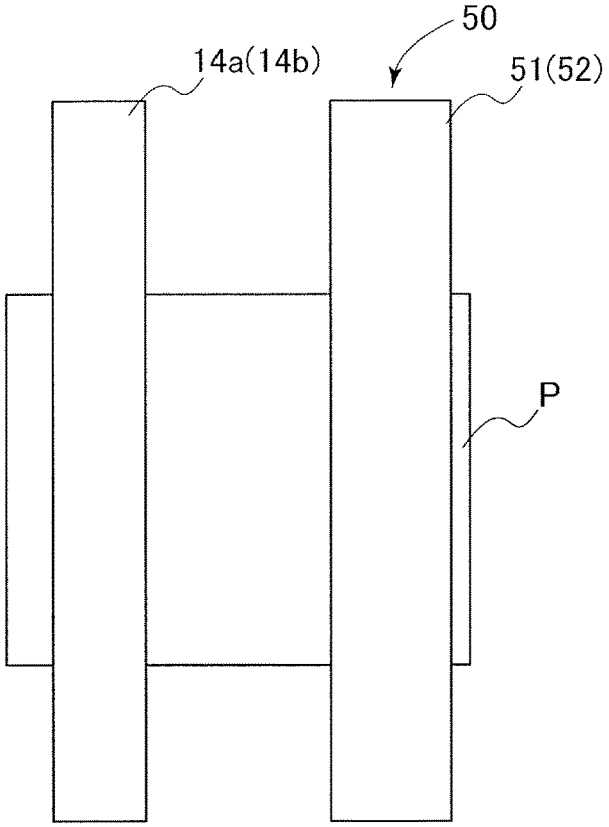
FIG. 10A is a diagram illustrating a posture of the recording material immediately before the reciprocal motion in the width direction in a conventional example.
Figure 10B:
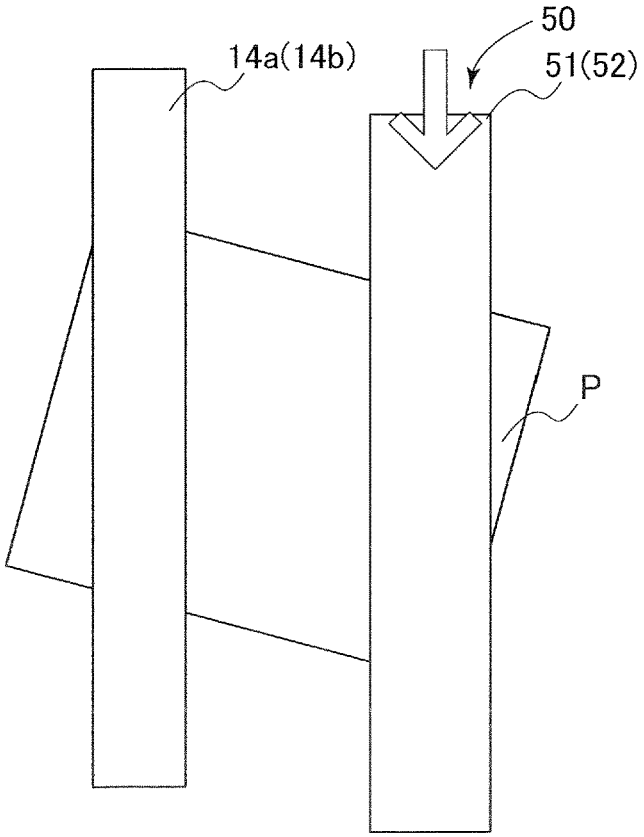
FIG. 10B is a diagram illustrating the posture of the recording material immediately after the reciprocal motion in the width direction in the conventional example.

Incidentally, the image forming apparatus 100 of this embodiment carries out a double-sided image formation in a so-called through pass method in which a toner image on a second surface of the recording material P is automatically formed and fixed successively after a formation and fixation of the toner image on a first surface of the recording material P. In a case of the image forming apparatus in this method, conventionally, it happens at a formation and fixation of the toner image on the second surface of the recording material P that the recording material P is reconveyed to the secondary transfer portion T2 via the conveyance path 114 in a rotated and tilted posture due to the width direction reciprocal motion of the fixing unit 50. FIG. 10A illustrates the posture of the recording material P immediately before the width direction reciprocal motion is carried out in a conventional example, and FIG. 10B illustrates the posture of the recording material P immediately after the width direction reciprocal motion is carried out in the conventional example.

As illustrated in FIG. 10A, when the trailing edge of the recording material P is being sandwiched between the fixing belt 51 and the pressurizing roller 52, it happens that the leading edge of the recording material P is sandwiched between the pair of discharge rollers 14*a* and 14*b*. Since the width direction reciprocal motion is carried out in this state and moves the fixing unit 50 in the width direction, the trailing edge of the recording material P being sandwiched between the fixing belt 51 and the pressurizing roller 52 is moved in the width direction. On the other hand, since the discharge rollers 14*a* and 14*b* are not moved in the width direction by the width direction reciprocal motion, the leading edge of the recording material P being sandwiched between the discharge rollers 14*a* and 14*b* is not moved in the width direction. Accordingly, the recording material P is not conveyed in a correct posture (the posture illustrated in FIG. 10A) but conveyed in a tilted posture. As the recording material P is conveyed in the tilted posture due to the width direction reciprocal motion as described above, it happens that the positions of images on the first and second surfaces (front/rear registration) deviate each other in a case of forming and fixing the toner image on the second surface of the recording material P successively after the first surface. This is because the recording material P is conveyed to the secondary transfer portion T2 in the tilted posture without correction at a secondary transfer of the toner image on the second surface of the recording material P at the secondary transfer portion T2.

Reciprocal Motion Control Processing

Therefore, in this embodiment, the reciprocal motion of the fixing unit 50 is made controllable so that the recording material P is not conveyed to the secondary transfer portion T2 in the tilted posture in the case of forming and fixing the toner image on the second surface of the recording material P successively after the first surface. A reciprocal motion control processing of this embodiment will be described using FIG. 8 with reference to FIGS. 4 and 7. The reciprocal motion control processing is started with a start of the image forming job by the control unit 300, and is ended with a completion of the image forming job.

Figure 8:
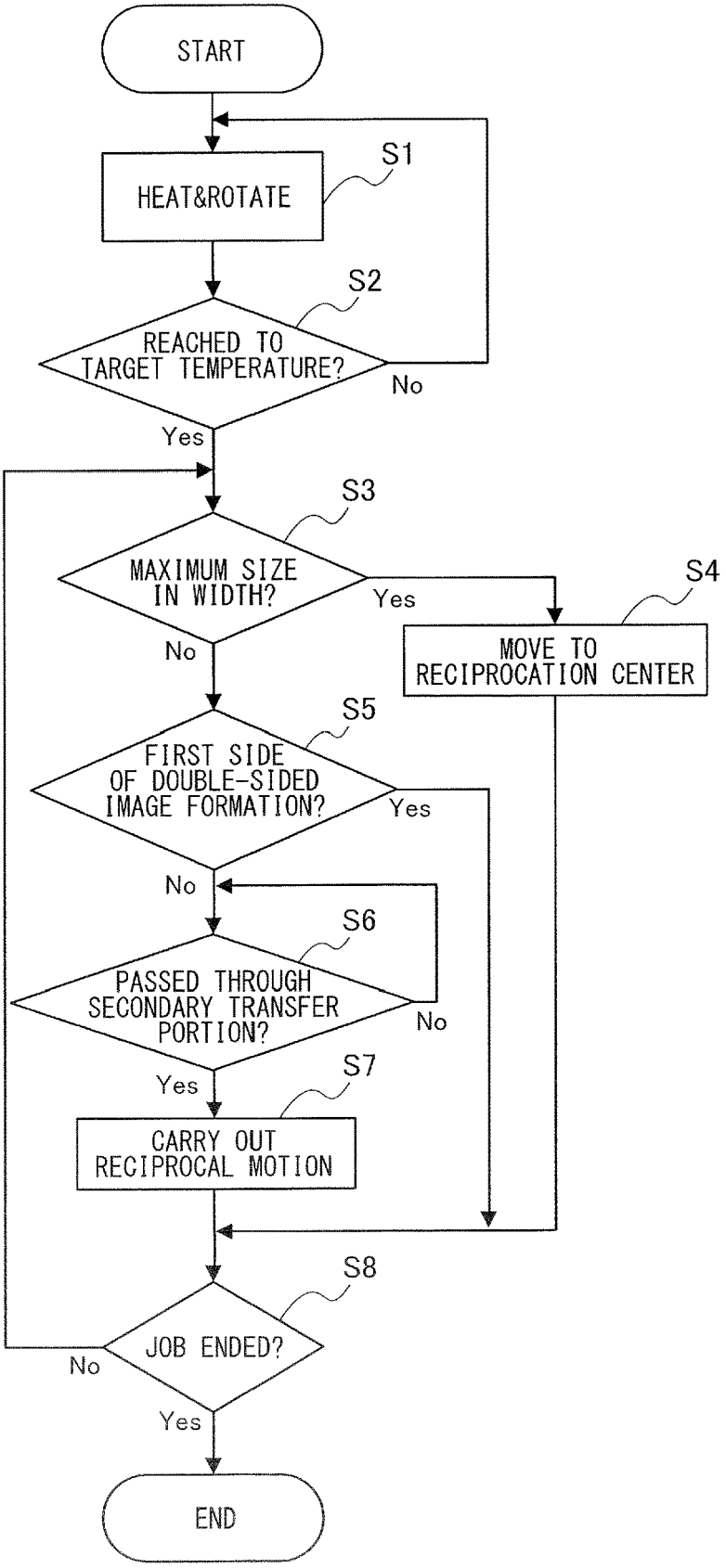
FIG. 8 is a flow chart illustrating a reciprocation mechanism control processing.

As illustrated in FIG. 8, the control unit 300 rotates the fixing belt 51 by drivingly rotating the pressurizing roller 52 with the motor M1, and at a same time controls the induction heating unit 502 by the power source E1 to obtain the desired target temperature on the surface of the fixing belt 51 (step S1). When the surface temperature on the fixing belt 51 reaches at the desired target temperature (Yes in step S2), the control unit 300 determines based on a size of the recording material P input via the operation unit 400 whether or not a length of the recording material P in the width direction is a maximum size in the width possible for the image formation (step S3). When the length of the recording material P in the width direction is the maximum size in the width (for example 330 mm) (Yes in step S3), the control unit 300, before the recording material P reaches at the fixing nip portion N, moves the fixing unit 50 to the reciprocation center described above by controlling the reciprocation motor M2 (step S4). Then, the control unit 300 ends this reciprocal motion control processing.

On the other hand, when a length of the recording material P in the width direction is not the maximum size in the width (No in step S3), the control unit 300 determines whether or not the toner image is formed on the first surface of the recording material P in the double-sided image formation (first surface in double-sided image formation) (step S5). When the toner image of the first surface of the double-sided image formation is formed on the recording material P (Yes in step S5), the control unit 300 jumps to a processing of a step S8. In this case, the width direction reciprocal motion of the fixing unit 50 is not carried out. On the other hand, when the toner image of the second surface of the double-sided image formation is formed on the recording material P (No in step S5), the control unit 300 determines whether or not the recording material P has passed the secondary transfer portion T2 (step S6). The control unit 300 holds the processing until the recording material P passes the secondary transfer portion T2 (No in step S6). When the recording material P has passed the secondary transfer portion T2 (Yes in step S6), the control unit 300 carries out the width direction reciprocal motion of the fixing unit 50 (step S7). The reason why the width direction reciprocal motion is carried out after the recording material P has passed the secondary transfer portion T2 is to secure a suitable transfer of the toner image in a process of a toner image transfer at the secondary transfer portion T2. That is, the control unit 300 operates the reciprocation mechanism 700 when the recording material P of the toner image formed on the second surface is not at the secondary transfer portion T2 but at the fixing nip portion N. To be noted, the moving amount of the width direction reciprocal motion at one-time is, for example, 0.2 mm.

Then, the control unit 300 determines whether or not the image forming job has ended (step S8). When the image forming job has not ended (No in step S8), the control unit 300 returns to the processing of a step S3 and repeats the processing of the step S3 to S8 described above. On the other hand, when the image forming job has ended (Yes in step S8), the control unit 300 ends this reciprocation control processing.

Figure 9:
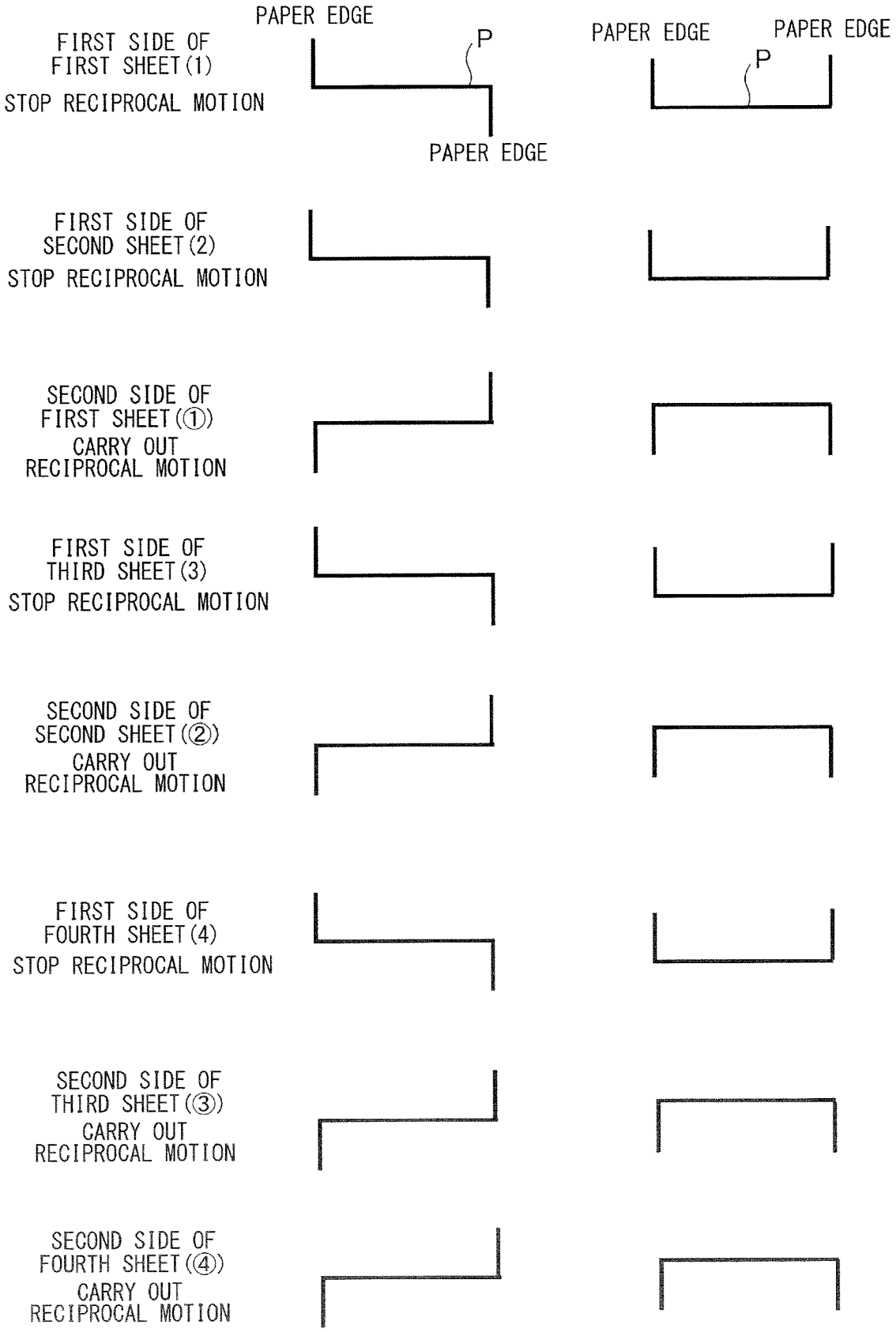
FIG. 9 is a diagram for a description of a reciprocal motion in the width direction.

FIG. 9 illustrates whether or not the width direction reciprocal motion of the fixing unit 50 is carried out in a case of the double-sided image formation on successive 4 sheets of the recording material P. On the left-hand side of FIG. 9, a case of paper edge defects being created at a different edge of both sides of the recording material P each other is illustrated, and on the right-hand side of FIG. 9, a case of the paper edge defects being created at both ends of one side of the recording material P is illustrated. In these figures, for each sheet of the recording material P, the first surface is indicated by only a numeric character in parentheses, and the second surface is indicated by a numeric character rounded by circle in the parentheses. That is, a same numeric character indicates a same sheet of the recording material P, and the first surface and the second surface are identified by whether or not the numeric character is rounded by the circle. As the image forming apparatus 100 of this embodiment is the through pass method, the first surface of the recording material P and the second surface of the recording material P are mixed and pass the fixing unit 50 as illustrated in FIG. 9. In this embodiment, the width direction reciprocal motion is not carried out in a case of the first surface of the recording material P, and carried out in a case of the second surface (numeric character rounded by circle) of the recoding material P. As described above, a frequency of the width direction reciprocal motion of the fixing unit 50 is decreased hitherto (halved in this case), a creation of the paper edge flaw is suppressed since the paper edge defect of the recording material P passing the fixing unit 50 alternately changes in direction in the double-sided image formation.

To verify effectiveness of this embodiment, using the image forming apparatus 100 of the present embodiment, the double-sided image formation in blue color is carried out in succession on 5000 sheets of GF-0081 (manufactured by Canon: A4 size with a grammage of 81 g/m$^2$). Table 1 shows results of a front/rear registration error measurement and results of the paper edge flaw observed by feeding a GF-C300 (manufactured by Canon: 13 inches in a width and 19 inches in a length with the grammage of 300 g/m$^2$). For comparison, Table 1 shows a comparative example where the width direction reciprocal motion is carried out regardless of the first and second surfaces, and an example where the width direction reciprocal motion is not carried out regardless of the first and second surfaces (stopping reciprocation). The front/rear registration error is shown by a maximum difference in a width of a blank space measured at the edge of a blue image on a front and rear sides.

TABLE 1

| | Comparative Example | This Embodiment | Stopping Reciprocation |
|---|---|---|---|
| Paper Edge Flaw | Not Distinguishable | Not Distinguishable | Distinguishable |
| Front/Rear Registration Error | 1.5 mm | 0.5 mm | 0.5 mm |

As found in Table 1, in a case of the comparative example, the paper edge flaw is not a problem since the width direction reciprocal motion is carried out. But, the front/rear registration error is larger than this embodiment. And, in a case of the stopping reciprocation, the front/rear registration error is similar to the present embodiment and within an allowable range of equal to and less than 0.5 mm, but the paper edge flaw is distinguishable as compared with this embodiment. Also, a frequency of the width direction reciprocal motion in the present embodiment is less than the frequency of the comparative example in which the width direction reciprocal motion is carried out regardless of the first and second surfaces. Despite that, similar results are obtained regarding the paper edge flaw in the cases of the comparative example and this embodiment as shown in Table 1.

As described above, in this embodiment, in a case of the recording material P with the toner image formed on the first surface of the double-sided image formation, the width direction reciprocal motion of the fixing unit 50 is not carried out. On the other hand, in a case of the recording material P with the toner image formed on the second surface of the double-sided image formation, the width direction reciprocal motion of the fixing unit 50 is carried out. By controlling in this way, in a case of forming and fixing the toner image on the second surface of the recording material P in succession of the first surface, the recording material P is not conveyed to the secondary transfer portion T2 in the tilted posture, and, accordingly, the deviation in the front/rear registration is suppressed. Also, since the width direction reciprocal motion is carried out in case of the second surface of the recording material P, though the frequency of the width direction reciprocal motion is decreased as compared with a conventional one, it is possible to suppress the local creation of the deep and large flaw on the fixing belt 51 by scattering the flaw caused by the paper edge along the width direction. Accordingly, in this embodiment, it is possible to easily achieve compatible suppression of both the local creation of the flaw caused by the paper edge and the deviation in the registration of the images on the first surface and the second surface in the double-sided image formation.

To be noted, in a case of a single-sided image formation of forming the image only on the one side of the recording material P, the control unit 300 operates the reciprocation mechanism 700 when the recording material P with the image formed on the first surface is at the fixing nip portion N.

Other Embodiment

In the embodiment described above, the width direction reciprocal motion of the fixing unit 50 is not carried out in a case of the first surface of the recording material P, but it is not limited to this. For example, in a case of the first surface of the recording material P, the width direction reciprocal motion of the fixing unit 50 can be carried out slightly to an extent not affecting the front/rear registration. That is, when the recording material P with the toner image formed on the first surface is at the fixing nip portion N, the fixing unit 50 is moved by the width direction reciprocal motion by as much as a first moving amount. In contrast, when the recording material P with the toner image formed on the second surface is at the fixing nip portion N, the fixing unit 50 is moved by the width direction reciprocal motion by as much as a second moving amount which is larger than the first moving amount. With referring to FIG. 11, another embodiment of the reciprocation control processing will be described.

Figure 11:
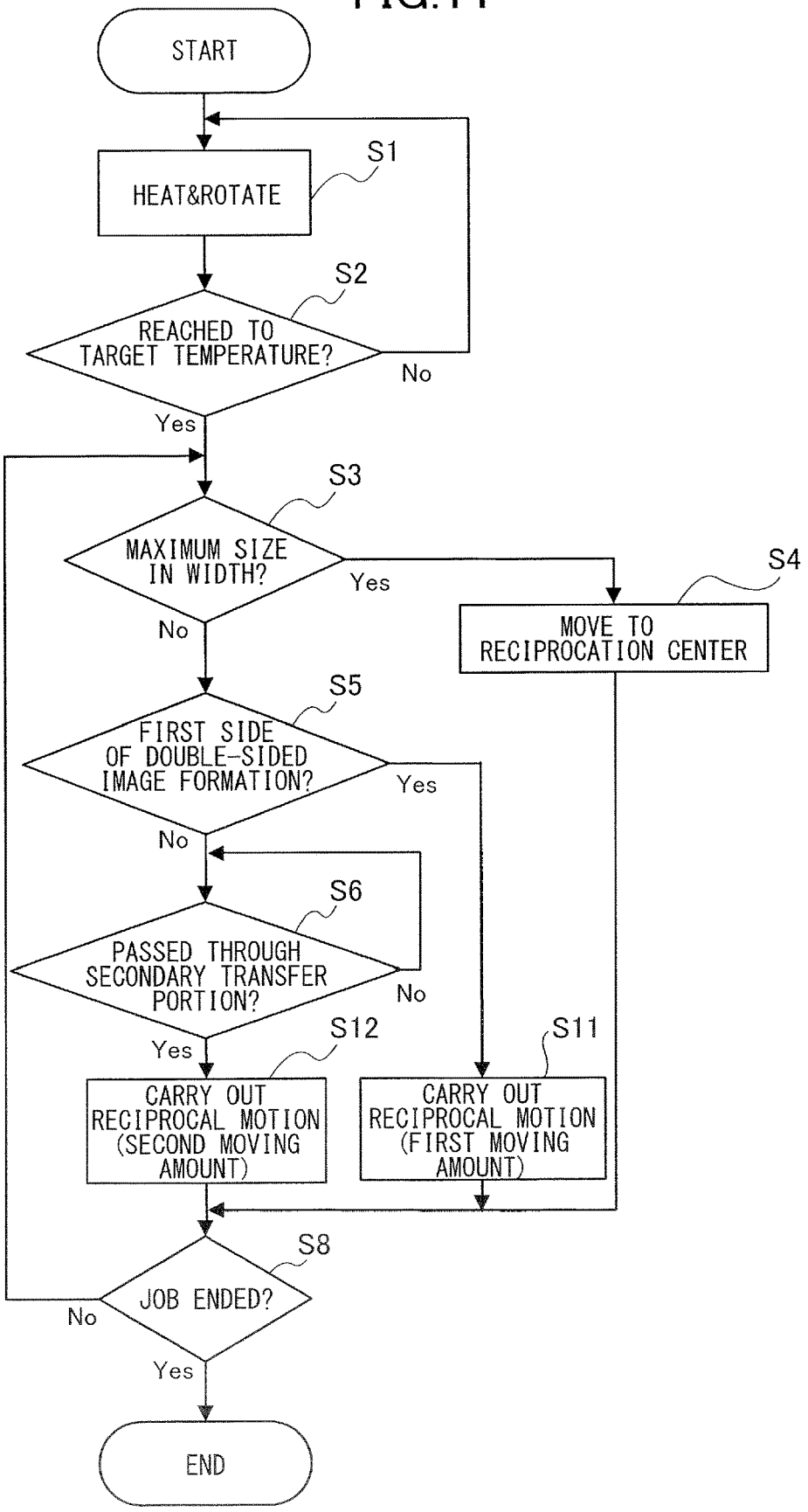
FIG. 11 is a flow chart illustrating a reciprocation mechanism control processing according to a second embodiment.

The reciprocation control processing illustrated in FIG. 11 is different from the reciprocation control processing illustrated in FIG. 8 in respect of the control unit 300 carrying out the width direction reciprocal motion (step S11) in a case of the recording material P with the toner image formed on the first surface of the double-sided image formation (Yes in step S5). Also, it is different in respect of the width direction reciprocal motion (step S12) that the control unit 300 carries out the width direction reciprocal motion in a case of the recording material P with the toner image formed on the second surface of the double-sided image formation (No in step S5 and Yes in step S6). The processing other than described above is similar to the reciprocation control processing illustrated in FIG. 8, and description thereof is omitted herein by putting a same mark.

As illustrated in FIG. 11, in a case of the recording material P with the toner image formed on the first surface of the double-sided image formation (Yes in step S5), the control unit 300 carries out the width direction reciprocal motion and moves the fixing unit 50 by as much as the first moving amount (for example, 0.04 mm) (step S11). On the other hand, in a case of the recording material P with the toner image formed on the second surface of the double-sided image formation (No in step S5 and Yes in step S6), though the control unit 300 carries out the width direction reciprocal motion (step S12), the control unit 300 moves the fixing unit 50 by as much as the second moving amount (for example, 0.2 mm) which is larger than the first moving amount.

As described above, it is acceptable to slightly move the fixing unit 50 by the width direction reciprocal motion to an extent not affecting the deviation in the front/rear registration in the operation of forming and fixing the toner image on the first surface of the recording material in the double-sided image formation. By controlling the reciprocation processing as described above, it is also possible to obtain an effect of easily achieving to compatibly suppress both the local creation of the flaw caused by the burr on the paper edge and the deviation in the registration of the images on the first surface and the second surface in the double-sided image formation. To be noted, in a case of the single-sided image formation, the reciprocation mechanism 700 moves the fixing unit 50 by as much as the second moving amount in this embodiment.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-042676, filed Mar. 8, 2019, which is hereby incorporated by reference herein in its entirety.

What is claimed is:

1. An image forming apparatus comprising:

an image forming unit configured to form a toner image;

a transferring portion configured to transfer the toner image formed by the image forming unit onto a recording material at a transferring nip portion;

a fixing unit comprising a first rotary member and a second rotary member configured to form a fixing nip portion for fixing the toner image formed by the image forming unit on the recording material, in cooperation with the first rotary member;

a reciprocation mechanism configured to reciprocally move the fixing unit in a width direction intersecting with a conveyance direction of the recording material;

a duplex conveyance unit configured to reverse a recording material of which a toner image is fixed on a first surface and reconvey the recording material to the image forming unit in a double-sided image formation in which toner images are formed and fixed on the first and second surfaces of the recording material;

an acquirer configured to, in a case where a recording material is conveyed through the fixing unit for fixing a toner image formed thereon during the double-sided image formation, acquire information regarding whether the recording material conveyed through the fixing unit is for fixing a toner image on the first surface thereof or for fixing a toner image on the second surface thereof; and a controller configured to control the reciprocation mechanism based on the information acquired by the acquirer, wherein in a case of executing the double-sided image formation, the controller is configured to prohibit an operation of the reciprocation mechanism when the information acquired by the acquirer indicates that the recording material conveyed through the fixing unit is for fixing a toner image on the first surface thereof, and to allow the operation of the reciprocation mechanism when the information acquired by the acquirer indicates that the recording material conveyed through the fixing unit is for fixing a toner image on the second surface thereof.

2. The image forming apparatus according to claim 1, wherein the controller is configured to control the reciprocation mechanism to move the fixing unit in the width direction while the fixing unit is nipping and conveying the recording material at the fixing nip portion for fixing the toner image on the first surface of the recording material in a single-sided image formation to form and fix a toner image on only the first surface of the recording material.

3. The image forming apparatus according to claim 2, wherein the reciprocation mechanism moves the fixing unit in the width direction at each conveyance of a predetermined number of sheets of the recording material to the fixing nip portion.

4. The image forming apparatus according to claim 1, further comprising an image bearing member configured to bear a toner image, and a transfer member configured to form the transferring nip portion to transfer the toner image on the image bearing member to the recording material, wherein the controller is configured to control the reciprocation mechanism to move the fixing unit in the width direction in a case where the recording material is not at the transferring nip portion.

5. The image forming apparatus according to claim 1, wherein the controller is configured to allow the operation of the reciprocation mechanism, while the recording material is at the fixing nip portion for fixing the toner image on the second surface of the recording material at the transferring nip portion.

6. The image forming apparatus according to claim 1, wherein in a case where the double-sided image formation is continuously executed for a plurality of sheets of the recording material including a first sheet and a second sheet such that, after the first sheet of which a first surface has a toner image transferred thereon is conveyed to the fixing nip portion, the second sheet of which a first surface has a toner image transferred thereon is conveyed to the fixing nip portion following the first sheet, the controller is configured to prohibit the operation of the reciprocation mechanism while the first sheet is at the fixing nip portion for fixing the toner image on the first surface of the first sheet and while the second sheet is at the fixing nip portion for fixing the toner image on the first surface of the second sheet, and to allow the operation of the reciprocation mechanism while the first sheet is at the fixing nip portion for fixing a toner image on the second surface of the first sheet and while the second sheet is at the fixing nip portion for fixing a toner image on the second surface of the second sheet.

7. The image forming apparatus according to claim 1, wherein in a case where the double-sided image formation is executed such that (i) sheets of the recording material for fixing the toner image on the first surface thereof and (ii) sheets of the recording material for fixing the toner image on the second surface thereof are passed through the fixing unit in a mixed order in which at least a part of the (ii) sheets of the recording material for fixing the toner image on the second surface thereof do not appear every predetermined number of sheets in the mixed order, the controller is configured to determine whether to prohibit or allow the operation of the reciprocation mechanism for each sheet of the recording material based on which surface of the sheet has the toner image formed thereon, so as to prohibit the operation of the reciprocation mechanism for each of the (i) sheets of the recording material for fixing the toner image on the first surface thereof is at the fixing nip portion, and to allow the operation of the reciprocation mechanism for each of the (ii) sheets of the recording material for fixing the toner image on the second surface thereof.

8. An image forming apparatus comprising:

an image forming unit configured to form a toner image;

a transferring portion configured to transfer the toner image formed by the image forming unit onto a recording material at a transferring nip portion;

a fixing unit comprising a first rotary member and a second rotary member, the second rotary member configured to abut on the first rotary member and form a fixing nip portion for fixing the toner image formed by the image forming unit on the recording material, in cooperation with the first rotary member;

a reciprocation mechanism configured to reciprocally move the fixing unit in a width direction intersecting with a conveyance direction of the recording material;

a duplex conveyance unit configured to reverse a recording material of which a toner image is fixed on a first surface of the recording material and reconvey the recording material to the image forming unit in a double-sided image formation in which toner images are formed and fixed on the first and second surfaces of the recording material; and a controller configured to control the reciprocation mechanism, wherein in a case of executing the double-sided image formation, the controller is configured to set a moving amount of the fixing unit in the width direction per one operation of the reciprocation mechanism to a first moving amount in a case of moving the fixing unit by the reciprocation mechanism while the recording material is at the fixing nip portion for fixing the toner image on the first surface of the recording material, and to set the moving amount of the fixing unit in the width direction per one operation of the reciprocation mechanism to a second moving amount larger than the first moving amount in a case of moving the fixing unit by the reciprocation mechanism while the recording material is at the fixing nip portion for fixing the toner image on the second surface of the recording material.

9. The image forming apparatus according to claim 8, wherein the reciprocation mechanism is configured to move the fixing unit in the width direction at each conveyance of a predetermined number of sheets of the recording material to the fixing nip portion.

10. The image forming apparatus according to claim 8, further comprising an image bearing member configured to bear a toner image, and a transfer member configured to form the transferring nip portion to transfer the toner image on the image bearing member to the recording material, wherein the controller is configured to control the reciprocation mechanism to move the fixing unit in the width direction in a case where the recording material is not at the transferring nip portion.

11. The image forming apparatus according to claim 8, wherein, in a single-sided image formation to form a toner image on only one side of the recording material, the controller is configured to set the moving amount of the fixing unit to the second moving amount in a case of moving the fixing unit by the reciprocation mechanism.

* * * * *